US005649886A

United States Patent [19]

Danylieko

[11] Patent Number: 5,649,886

[45] Date of Patent: Jul. 22, 1997

[54] WORKOUT BENCH

[76] Inventor: Richard A. Danylieko, 1747 Pam Cir., Orlando, Fla. 32809

[21] Appl. No.: 628,561

[22] Filed: Apr. 10, 1996

[51] Int. Cl.[6] ..... A63B 21/00

[52] U.S. Cl. ..... 482/142; 482/104

[58] Field of Search ..... 482/100, 104, 482/130, 134, 136–138, 142, 148; 5/622, 636, 900.5; 297/391, 396

[56] References Cited

U.S. PATENT DOCUMENTS

| | | | |
|---|---|---|---|
| 309,678 | 12/1884 | Aubin | 5/622 |
| 4,653,751 | 3/1987 | Green | 482/104 |
| 5,348,523 | 9/1994 | Blount | 482/104 |

*Primary Examiner*—Richard J. Apley
*Assistant Examiner*—John Mulcahy

[57] ABSTRACT

A workout bench having improved spinal support as a result of arcuate lateral indentations positioned for the shoulder area of a user to allow the user an increased range of shoulder blade motion during the lifting of free weights in a supine position, thereby relieving pressure on the neck and spine of the user during the performance of press exercises. The workout bench also has a lowered head support attached, to the end of the spinal support near to the arcuate lateral indentations, by a step-down neck support which positions the user's head below the normally horizontal plane of the spinal support for further relief of pressure on the neck and spine of the user during the performance of press exercises. Applications may include, but are not limited to, use during the performance of press exercises and other exercises involving the use of free weights when laying on one's back.

11 Claims, 3 Drawing Sheets

WORKOUT BENCH

BACKGROUND

1. Field of the Invention

This invention relates to weight lifting benches and workout benches, specifically to a workout bench having improved spinal support as a result of arcuate lateral indentations positioned for the shoulder blade area of a user to allow the user an increased range of shoulder blade motion during the lifting of free weights, thereby relieving pressure on the neck and spine of the user during the performance of press exercises. The workout bench also having a lower head support attached, at the end of the spinal support near to the arcuate lateral indentations, by a step-down neck support which positions the user's head below the normally horizontal plane of the spinal support, for further relief of pressure on the neck and spine of the user during the performance of press exercises. Applications may include, but are not limited to, use during the performance of press exercises and other exercises involving the use of free weights when laying on one's back.

2. Description of Prior Art

Workout benches provide a user with an elevated support surface on which to position a portion of the body while performing a variety of muscle flexing and muscle stretching exercises. Many workout benches are padded to provide a resilient surface on which to perform such exercises. Since workout benches are elevated above a floor surface, users may perform exercises on the support surface of the workout bench using a wider range of motion than would be possible if the identical exercise were performed on the floor surface. For example, when people lay on their backs on a floor surface, their outstretched arms may be raised between the horizontal floor surface and a vertical position, allowing a 90 degree range of motion. In contrast, users laying on their backs on the support surface of a workout bench may move their arms between a vertical position and a position below the horizontal plane of the support surface, allowing a range of motion greater than 90 degrees. However, even though workout benches provide a user with a greater range of motion over that possible when users perform identical exercises on a floor surface, the generally rectangular support surfaces of prior art workout benches and prior art weightlifting benches limit the downward motion of a user's shoulders and arms. Also, when the lower portion of a user's upper arms move below the horizontal plane of the workbench support surface during exercise, they engage the lateral edges of the support surface causing the neck and spine of the user to be raised from the support surface. This puts pressure on both the neck and spine of the user as long as the upper arms remain below the horizontal plane of the support surface. The increased pressure on the neck and spine of the user may not only cause discomfort for the user, it may lead to injury. Arcuate lateral indentations on each side of the workout bench in the area of a user's shoulders would allow an even greater range of motion than would be possible with a rectangular support surface. Also, such lateral indentations would reduce pressure placed upon the neck and spine of a user during the performance of press exercises. Another disadvantage of prior art workout benches and weightlifting benches is that the back of a user's head is placed flat upon the support surface during the performance of press exercises, and when so placed no support is offered for the user's neck. It is not known in the field of workout benches and weightlifting benches to have a workout bench with arcuate lateral indentations to allow a greater range of motion for the shoulder blades and upper arms of a user during the lifting of free weights, and also having a lowered head support connected to the remainder of the workout bench by a step-down neck support, which in combination with the arcuate lateral indentations act to relieve pressure on the user's neck and spine while the user is in a supine position during the performance of press exercises.

The prior art known to be most closely related to the present invention is the invention disclosed in U.S. Pat. No. 5,447,481 to Emter (1995). The Emter invention comprises a planar surface for supporting a user with a curved portion beneath the shoulder blades of the user which slopes downward on either side from a central apex coextensive with the top of the planar surface. Thus, the Emter invention provides a relieved zone beneath the user's shoulder blades which disengages the shoulder muscles and requires the user to accomplish bench press exercises strictly by use of pectoral muscles. Both the Emter invention and the present invention provide relief of pressure on the spine during the performance of press exercises. However, in contrast with the central apex of the Emter invention which is used to support the area of a user's back between the shoulder blades, the present invention provides a wider support surface for the area of the user's back between the shoulder blades. Also, the present invention provides a head support, and a downwardly angled neck support, which position a user's head below the plane of the spinal support for further relief of pressure on the neck and spine of the user during the performance of press exercises in a supine position. Further, the present invention has a simpler design than the Emter invention which would be easier and less costly to construct.

SUMMARY OF INVENTION—OBJECTS AND ADVANTAGES

It is the primary object of this invention to provide a workout bench with lateral indentations for the shoulder blades of a user to allow more freedom of shoulder blade movement during the performance of bench presses. It is also an object of this invention to provide a workout bench with lateral indentations for the shoulder blades of a user to relieve pressure on the spine of a user during the performance of press exercises. A further object of this invention is to provide workout bench with a downwardly angled neck support configured to the contour of a human neck and a head support lower than the horizontal plane of the remaining portion of the workout bench to give greater support to the head and neck of a user performing press exercises while laying upon the workout bench in a supine position. It is also an object of this invention to provide a workout bench allowing more freedom of shoulder blade movement to a user performing bench presses which is simple in design and easy to construct.

As described herein, properly manufactured and used to perform muscle stretching and muscle flexing exercises, the present invention would provide a comfortable workout bench which would relieve pressure on both the neck and spine of a user during press exercises performed in a supine position. Arcuate lateral indentations in the spinal support of the present invention, positioned beneath the user's shoulder blades, would allow the user greater freedom of shoulder blade movement when working with free weights. The head support of the present invention, lower than the horizontal plane of the spinal support and working in conjunction with a sloping step-down neck support, offers greater support of neck and spine than prior art workout benches and prior art weightlifting benches. Since greater freedom of shoulder blade movement is offered to a user working in a supine position with free weights by arcuate lateral indentations in the spinal support, the present invention would be easier and less costly to construct than prior art workout bench inventions having a curved portion downwardly depending on both sides from a central apex. The present invention may be constructed with a one-piece, non-adjustable spinal support, or with a spinal support and a separate lower body support, each of which may be upwardly inclined.

The description herein provides preferred embodiments of the present invention but should not be construed as limiting the scope of the workout bench invention. Variations in the length of the spinal support, the length of the lower body support, the profile of the shoulder cutout areas, the height and the shape of the legs supporting the spinal support, the type of mechanisms used for inclining the spinal support and the lower body support, the shape of the head support, the type of padding used on the spinal support, the width of the spinal support and the lower body support, and the type of brace used between the legs, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
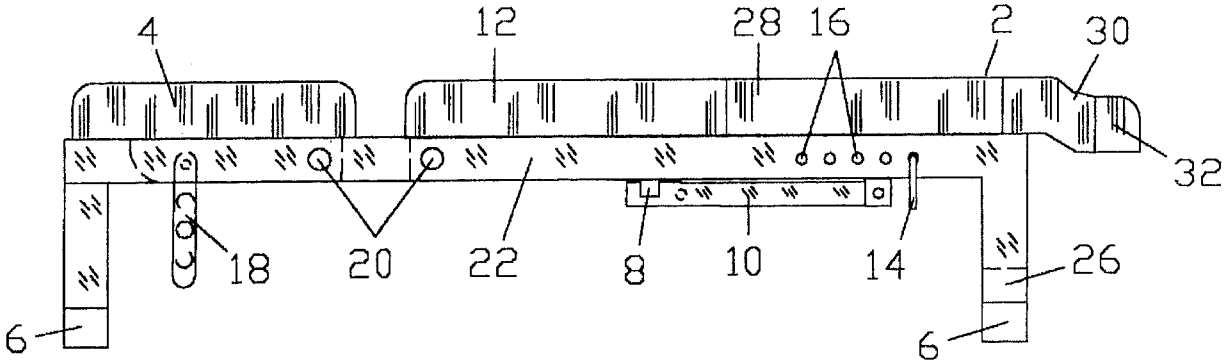
FIG. 1 is a side view of a first embodiment of the invention having an adjustable spinal support and an adjustable lower body support.

FIGS. 1–6 show a first embodiment of a workout bench 2 which is adjustable in angular configuration. FIG. 1 shows workout bench 2 having an elongated spinal support 12 attached to a frame 22. Frame 22 is supported on legs 6 with a brace 26 positioned between legs 6. Although brace 26 is shown in FIG. 1 as a one-piece unit, the configuration of brace 26 is not critical to workout bench 2. Also, even though the presence of brace 26 is preferred to strengthen and stabilize workout bench 2, and it is preferred for brace 26 to be welded to legs 6, brace 26 is not critical to the construction of workout bench 2. FIG. 1 also shows a lower body support 4 attached to frame 22 with one of its ends adjacent to one end of spinal support 12. Two pivoting bars 20 are shown attached to frame 22 beneath the adjacent ends of spinal support 12 and lower body support 4 to allow both spinal support 12 and lower body support 4 to pivot therefrom in an upward direction from a normally horizontal position. A head support 32 is attached to the end of spinal support 12 remote from lower body support 4 by a downwardly angled neck support 30 so that head support 32 is positioned below the horizontal plane of spinal support 12. It is contemplated for neck support 30 to have an angled surface configured to the contour of a human neck (not shown). FIG. 1 also shows an adjusting brace 18 attached between frame 22 and lower body support 4 for use in upwardly inclining the end of lower body support 4 remote from spinal support 12. Adjusting brace 18 is shown to have several apertures therethrough for attachment to frame 22 to provide selective inclination of lower body support 4 into any one of several predetermined fixed positions. FIG. 1 further shows inclining means for spinal support 12 comprising a brace beam 10, a clamp 8 for securing brace beam 10 in a fixed position when spinal support 12 is in a horizontal position, adjusting holes 16 on frame 22, and a pin 14 for selective insertion into each adjusting hole 16 for upwardly inclining spinal support 12 into any one of several predetermined fixed positions.

Figure 2:
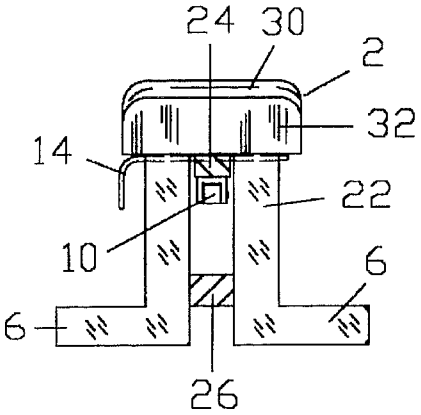
FIG. 2 is a front view of the first embodiment of the invention.
Figure 4:
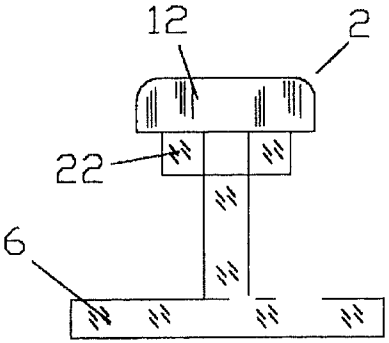
FIG. 4 is a sectional view of the first embodiment of the invention.
Figure 3:
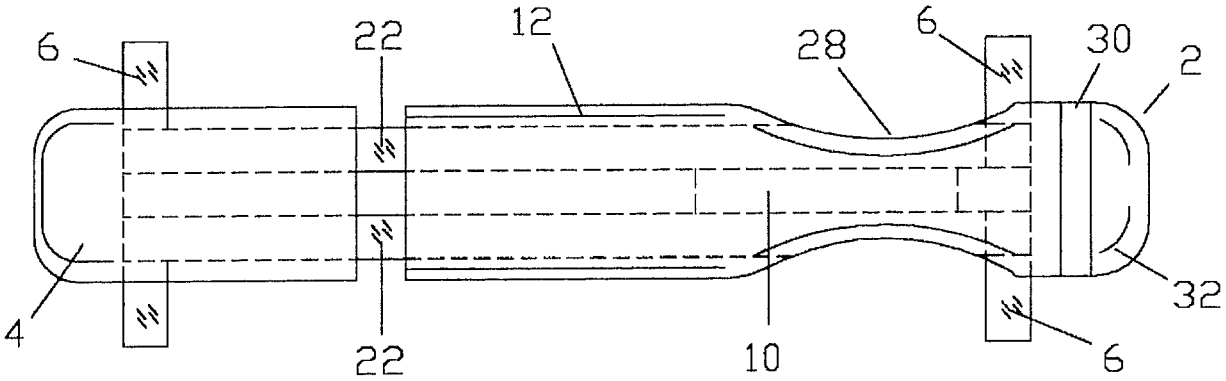
FIG. 3 is a top view of the first embodiment of the invention.

FIG. 2 shows the first embodiment of workout bench 2 having an adjusting bar 24 positioned beneath head support 32 and above brace beam 10. FIG. 2 also shows workout bench 2 having neck support 30, frame 22, legs 6, and brace 26. Similarly, FIG. 3 shows the first embodiment of workout bench 2 having spinal support 12 and lower body support 4 positioned in an end-to-end alignment longitudinally above frame 22. FIG. 3 also shows spinal support 12 having arcuate lateral indentations 28, neck support 30 connected to spinal support 12, head support 32 depending from the remote end of neck support 30, legs 6 attached to frame 22, and brace beam 10 positioned beneath spinal support 12. Arcuate lateral indentations 28 are positioned on spinal support 12 so that arcuate lateral indentations 28 will be placed beneath the shoulder blade area of a user's back (not shown). In a like manner, FIG. 4 shows workout bench 2 having spinal support 12 attached to frame 22 and frame 22 supported on legs 6.

Figure 6:
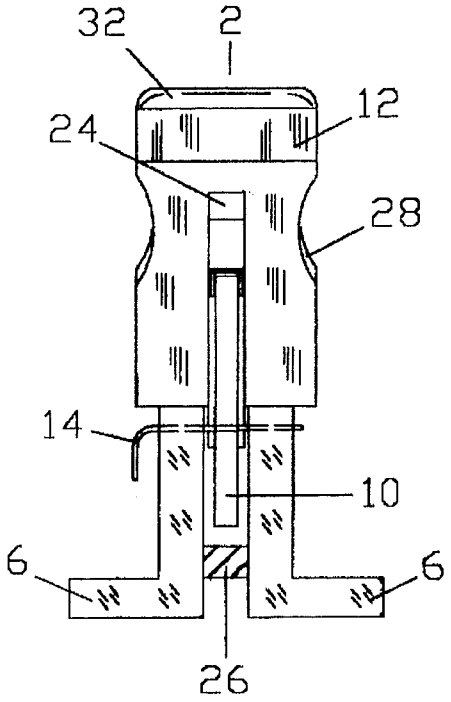
FIG. 6 is a front view of the first embodiment of the invention with the spinal support in an inclined position.
Figure 5:
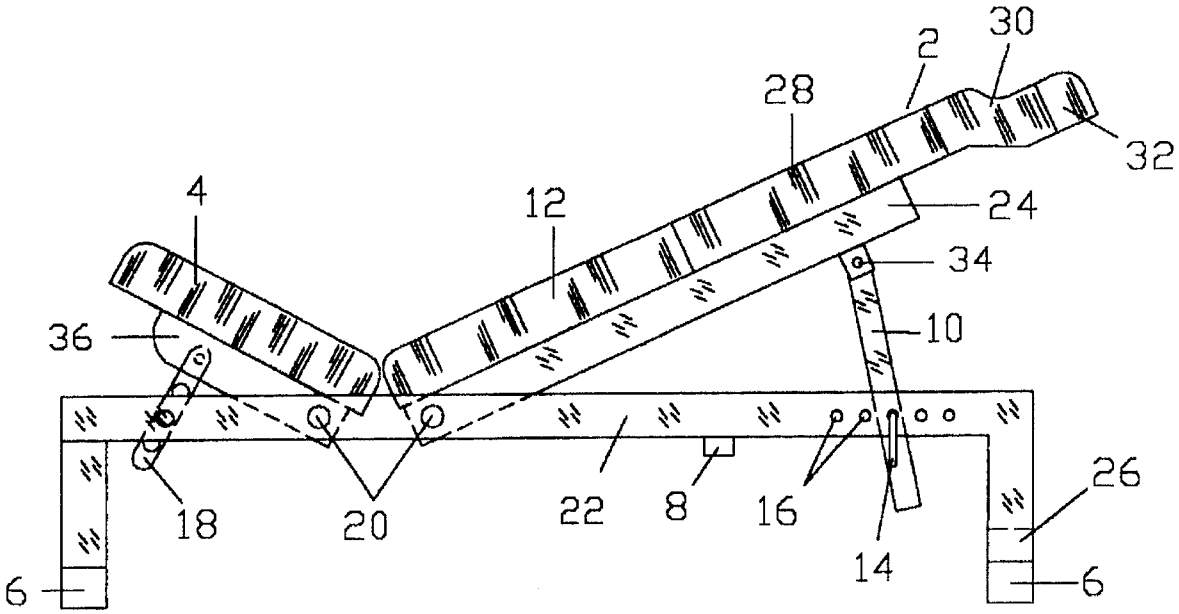
FIG. 5 is a side view of the first embodiment of the invention with the spinal support and the lower body support in inclined positions.

FIG. 5 shows spinal support 12 and lower body support 4 in inclined positions relative to frame 22, both spinal support 12 and lower body support 4 pivoting upward from pivoting bars 20. FIG. 5 also shows a lower body support bar 36 attached to the underside of lower body support 4 and lower body support bar 36 fixed into its inclined position by adjusting brace 18. Brace beam 10 is detached from clamp 8 with pin 14 inserted into one adjusting hole 16 to fix spinal support 12 in the upwardly inclined position. FIG. 5 also shows brace beam 10 being attached to adjusting bar 24 by a hinge 34 which allows brace beam 10 to move toward clamp 8 when spinal support 12 is in a horizontal position. FIG. 5 also shows spinal support 12 having arcuate lateral indentations, neck support 30 attached thereto, head support 32 depending from neck support 30, legs 6 attached to frame 22, and brace 26 positioned between legs 6. FIG. 6 also shows spinal support 12 attached to adjusting bar 24 and in an upwardly inclined position. Further, FIG. 6 shows brace 26 between legs 6, pin 14 securing brace bar 10, arcuate lateral indentations 28 in spinal support 12, and head support 32 adjacent to spinal support 12.

Figure 8:
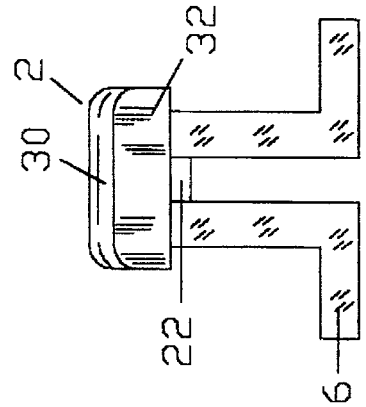
FIG. 8 is a front view of the second embodiment of the invention.
Figure 10:
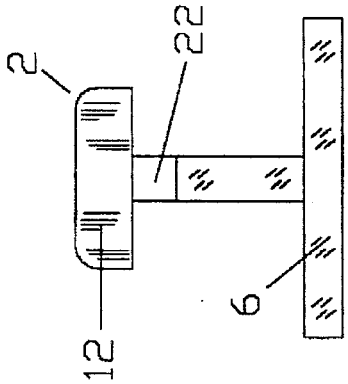
FIG. 10 is a sectional view of the second embodiment of the invention.
Figure 7:
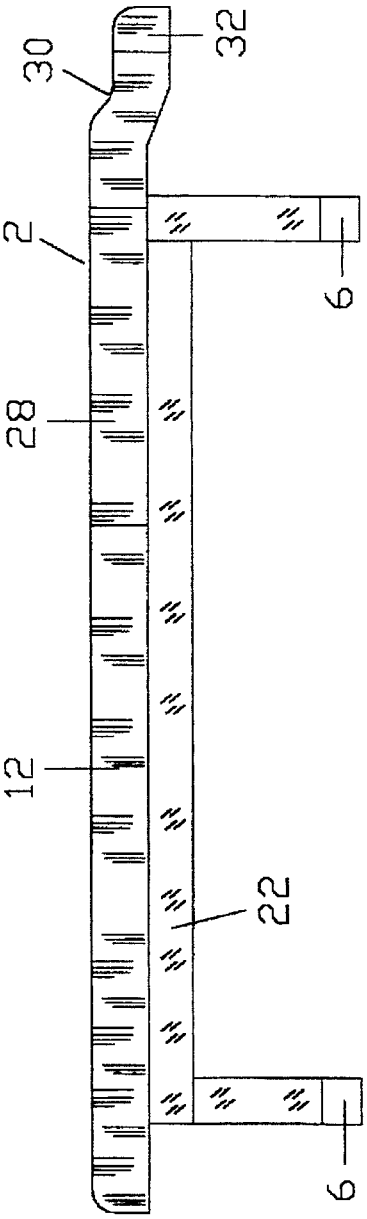
FIG. 7 is a side view of a second embodiment of the invention having a fixed spinal support.
Figure 9:
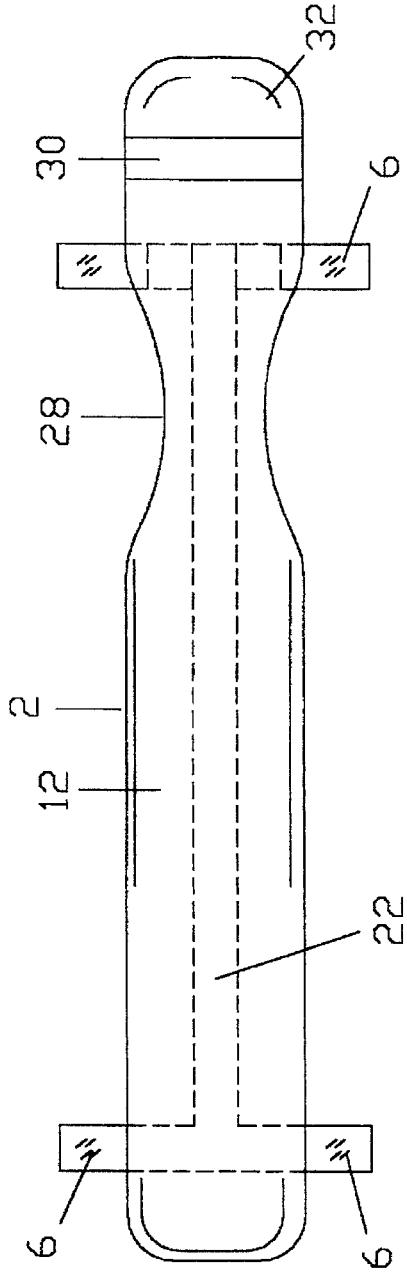
FIG. 9 is a top view of the second embodiment of the invention.

FIGS. 7–10 show a second embodiment of workout bench 2 which is fixed in configuration. FIGS. 7 and 9 show spinal support 12 secured to the upper surface of frame 22 and legs 6 supporting frame 22. Arcuate lateral indentations 28 are positioned on spinal support 12 between its center and one of its ends so that arcuate lateral indentations 28 are placed beneath the shoulder blade area of a user's back (not shown). FIG. 7 also shows neck support 30 attached to the end of spinal support 12 near to arcuate lateral indentations 28 and head support 32 depending from neck support 30. FIG. 8 shows workout bench 2 having frame 22 attached to legs 6 and neck support 30 and head support 32 positioned above frame 22. FIG. 10 shows workout bench 2 having spinal support 12 attached to frame 22 and frame 22 supported on legs 6.

Although not critical to workout bench 2, in the preferred embodiments it is contemplated for spinal support 12 and lower body support 4 to have padded upper surfaces (not shown). It is also contemplated for the distal ends of head support 32 and lower body support 4 in the first embodiment, and the distal ends of head support 32 and spinal support 12 in the second embodiment, to have rounded corners and edges. Also, in the preferred embodiments it is contemplated for frame 22 to be made of a strong metallic material, such as steel. The number of adjusting holes 16 in frame 22 and the number of apertures in adjusting brace 18 are not critical to workout bench 2. Further, the lengths of the spinal support 12, lower body support 4, neck support 30, and head support 32 are not critical to workout bench 2, although it is contemplated for the total length of the combined spinal support 12, lower body support 4, neck support 30, and head support 32 in the first embodiment, and the total length of the combined spinal support 12, neck support 30, and head support 32 in the second embodiment, to be approximately forty-eight inches. Also, in the preferred embodiments it is contemplated for head support 32 to be approximately six inches in length, the narrowest portion of spinal support 12 to be approximately twelve inches from the distal end of head support 32, the narrowest portion of spinal support 12 to be approximately four inches in width, and for the total length of each arcuate lateral indentation 28 to be approximately twelve inches. Further, the shape of head support 32, the widths of spinal support 12 and lower body support 4, as well as the profile of arcuate lateral indentations 28, the height and shape of legs 6 are not critical to workout bench 2. Also, the type of mechanisms used for inclining spinal support 12 and lower body support 4 are not critical to workout bench 2 and the use of inclining mechanisms other than adjusting brace 18, brace beam 10, holes 16, pin 14, hinge 34, and clamp 8 is possible without departing from the scope and intent of the present invention.

What is claimed is:

1. A workout bench comprising a frame having an upper surface; a spinal support secured to said upper surface, said spinal support having a center portion, a first end, and arcuate lateral indentations between said center portion and said first end so that said arcuate lateral indentations are configured for receiving the shoulder blade area of a user's back for increasing the range of motion of the shoulder blades of said user while said user performs muscle stretching and muscle flexing exercises, said workout bench further comprising a neck support having opposite ends, one of said opposite ends being attached to said first end of said spinal support in a downwardly sloping manner, said neck support configured to approximate the contour of a human neck, said workout bench further comprising a head support depending from the other of said opposite ends of said neck support so that said head support is in a lowered position relative to said spinal support when said spinal support is in a horizontal position and so that in combination said head support and said neck support function to relieve pressure from the head and neck of said user when said user is performing bench press exercises.

2. A workout bench comprising a frame having an upper surface, a spinal support secured to said upper surface, said spinal support having a center portion, a first end, and arcuate lateral indentations between said center portion and said first end so that said arcuate lateral indentations are configured for receiving the shoulder blade area of a user's back for increasing the range of motion of the shoulder blades of said user while said user performs muscle stretching and muscle flexing exercises with free weights, said workout bench also comprising a neck support having opposite ends, one of said opposite ends being attached to said first end of said spinal support in a downwardly sloping manner, said neck support configured to approximate the contour of a human neck; and a head support depending from the other of said opposite ends of said neck support so that said head support is in a lowered position relative to said spinal support when said spinal support is in a horizontal position and in combination said head support and said neck support function to relieve pressure from the head and neck of said user when said user is performing bench press exercises.

3. The workout bench of claim 2 further comprising a quantity of padding attached to said spinal support to provide a resilient surface for said user during performance of said muscle stretching and said muscle flexing exercises.

4. The workout bench of claim 2 wherein said spinal support has a second end and further comprising a lower body support secured to said upper surface of said frame, said lower body support having opposite end portions, one of said opposite end portions being positioned in a longitudinal end-to-end configuration adjacent to said second end of said spinal support.

5. The workout bench of claim 4 further comprising adjusting means attached between said frame and said spinal support, and also attached between said frame and said lower body support, so that said spinal support and said lower body support are both upwardly inclinable from a horizontal position.

6. The workout bench of claim 5 wherein said spinal support has a bottom surface and said lower body support has an underside surface, and wherein said adjusting means comprises a plurality of pivoting bars, at least one of said pivoting bars positioned between said second end of said spinal support and said frame, and at least one of said pivoting bars positioned between said frame and the one of said opposite end portions of said lower body support being adjacent to said spinal support, an adjusting brace connected between said frame and said lower body support, an adjusting bar attached to said bottom surface of said spinal support, hinging means attached to said adjusting bar, and a brace beam connected between said hinging means and said frame.

7. A workout bench comprising a frame having an upper surface; a spinal support secured to said upper surface, said spinal support having a center portion, a first end, a second end, and arcuate lateral indentations between said center portion and said first end so that said arcuate lateral indentations are configured for receiving the shoulder blade area of a user's back for increasing the range of motion of the shoulder blades of said user while said user performs muscle stretching and muscle flexing exercises with free weights; said workout bench also comprising a lower body support secured to said upper surface of said frame, said lower body support having opposite end portions, one of said opposite end portions being positioned in a longitudinal end-to-end configuration adjacent to said second end of said spinal support; adjusting means attached between said frame and said spinal support, said adjusting means also attached between said frame and said lower body support, so that said spinal support and said lower body support are both upwardly inclinable from a horizontal position; a neck support having opposite ends, one of said opposite ends being attached to said first end of said spinal support in a downwardly sloping manner, said neck support configured to approximate the contour of a human neck; and a head support depending from the other of said opposite ends of said neck support so that said head support is in a lowered position relative to said spinal support when said spinal support is in a horizontal position and in combination said head support and said neck support function to relieve pressure from the head and neck of said user when said user is performing bench press exercises.

8. The workout bench of claim 7 further comprising a quantity of padding attached to said spinal support to provide a resilient surface for said user during performance of said muscle stretching and said muscle flexing exercises.

9. The workout bench of claim 7 wherein said spinal support has a bottom surface and said lower body support has an underside surface, and wherein said adjusting means comprises a plurality of pivoting bars, at least one of said pivoting bars positioned between said second end of said spinal support and said frame, and at least one of said pivoting bars positioned between said frame and the one of said opposite end portions of said lower body support being adjacent to said spinal support, an adjusting brace connected between said frame and said lower body support, an adjusting bar attached to said bottom surface of said spinal support, hinging means attached to said adjusting bar, and a brace beam connected between said hinging means and said frame.

10. The workout bench of claim 7 wherein the combined lengths of said spinal support, said lower body support, said neck support, and said head support is approximately forty-eight inches.

11. The workout bench of claim 7 wherein said head support has a distal end, said head support is approximately six inches in length, the narrowest portion of said spinal support is approximately twelve inches from said distal end of said head support, said narrowest portion of said spinal support being approximately four inches in width, and each of said arcuate lateral indentation being approximately twelve inches in length.

* * * * *